US007066223B2

(12) United States Patent
Stone

(10) Patent No.: US 7,066,223 B2
(45) Date of Patent: Jun. 27, 2006

(54) LOG SPLITTING APPARATUS

(76) Inventor: Mark O. Stone, 181 Sleepy Hollow Rd., Hollister, MO (US) 65672

( * ) Notice: Subject to any disclaimer, the term of this patent is extended or adjusted under 35 U.S.C. 154(b) by 51 days.

(21) Appl. No.: 10/878,872

(22) Filed: Jun. 28, 2004

(65) Prior Publication Data

US 2005/0284542 A1 Dec. 29, 2005

(51) Int. Cl.
*B27L 7/06* (2006.01)

(52) U.S. Cl. ..... 144/195.1; 144/195.8; 144/193.2

(58) Field of Classification Search ..... 144/193.1, 144/193.2, 195.2, 195.6, 195.8, 195.1; 269/289 MR; 29/254, 281.1; 173/114, 125, 200, 204; 125/23.01, 125/24

See application file for complete search history.

(56) References Cited

U.S. PATENT DOCUMENTS

| | | | | |
|---|---|---|---|---|
| 4,019,549 | A | 4/1977 | Williams | |
| 4,073,325 | A | 2/1978 | Krom, Jr. | |
| 4,111,246 | A * | 9/1978 | La Pointe | 144/195.1 |
| 4,132,255 | A | 1/1979 | Thackery | |
| 4,155,385 | A | 5/1979 | Lapointe | |
| 4,444,231 | A | 4/1984 | Dillon | |
| 4,503,894 | A * | 3/1985 | Gratkowski | 144/195.1 |
| 4,615,367 | A | 10/1986 | Crowley, Jr. | |
| 4,700,759 | A * | 10/1987 | Duerr | 144/195.1 |
| 4,945,960 | A | 8/1990 | McCauley | |
| 5,144,995 | A | 9/1992 | Pettersson | |
| 5,490,740 | A * | 2/1996 | Johnson | 299/37.4 |
| 5,803,141 | A | 9/1998 | Patterson | |
| 6,408,907 | B1 * | 6/2002 | Lantz | 144/195.1 |
| 6,609,547 | B1 | 8/2003 | Machkovech | |

* cited by examiner

*Primary Examiner*—Derris H. Banks
*Assistant Examiner*—Shelley Self
(74) *Attorney, Agent, or Firm*—Dale J. Ream

(57) ABSTRACT

A hydraulic log splitter attachment for a skid steer loader includes a mounting framework attached to a vertical elongate beam. A piston/cylinder combination with a rod for movement between retracted and downwardly extended configurations mounts to the beam. A wedge attaches to a lower end of the rod. A base plate attaches to the beam adjacent the lower end; storage wall assemblies and stabilizing plates optionally attach to the base plate. Hoses connect the piston/cylinder combination to the loader's hydraulic system. Wedge guides slidably attach the wedge to the beam. The wedge guides optionally include wedge guide rollers; the wedge optionally includes wedge rollers. The loader secures to the mounting framework. Wood is placed on the base plate while the rod is in the retracted configuration. The rod moves to the downwardly extended configuration, thus splitting the wood with the wedge. The storage wall assemblies provide split wood storage.

19 Claims, 6 Drawing Sheets

LOG SPLITTING APPARATUS

BACKGROUND OF THE INVENTION

This invention relates generally to log splitters. In particular, the present invention relates to a hydraulically powered log splitter attachment for a skid steer loader.

Many people are unaware of the wide-ranging capabilities of a skid steer loader. While mainly used for digging and moving materials, there are many auxiliary products and attachments that perform a variety of useful functions. There are currently specialized attachments for digging, drilling, transporting materials, snow removal, and much more. However, a log splitting attachment is not commonly available.

Stand alone log splitters are common among people who use or produce firewood, and skid steer loaders are very popular because they are useful for all types of construction work. However, there has not been a significant effort to combine the functionality of these two products. The obvious advantage of this combination is that it would be more efficient and cost-effective than using two separate machines. An additional advantage is that it allows the user to easily move the log splitter to various areas where logs are stored rather than hauling logs from different locations to a single location where the log splitter is used.

While log splitting attachments for skid steer loaders are rare, log splitting attachments for backhoes and tractors are known. In fact, many devices have been produced combining log splitters with backhoes. Backhoes are better suited for this combination, as the dipper stick is often used to support a base for holding wood and a splitting member may be attached directly to the backhoe's free hydraulic piston. When the hydraulic piston extends, it presses the attached splitting member against and through the timber. Some devices using this arrangement are proposed in U.S. Pat. No. 4,073,325, U.S. Pat. No. 4,155,385, and U.S. Pat. No. 4,444,231.

Other devices have combined log splitters with backhoes in different ways. U.S. Pat. No. 4,019,549 uses the backhoe's dipper stick to move a piece of wood horizontally to a wedge assembly. U.S. Pat. No. 4,615,367 uses the backhoe's hydraulic power to operate log-splitting pincers mounted at the end of the dipper stick. U.S. Pat. No. 5,144,995 uses a grab at the end of the backhoe's dipper stick to maneuver timber to a severing means mounted on the backhoe. The backhoe is then driven toward a rock wall or similar object, forcing the timber along the severing means. The device in U.S. Pat. No. 5,803,141 mounts to a boom to split wood horizontally. These are all incompatible with skid steer loaders, which do not have dipper sticks or booms.

U.S. Pat. No. 4,132,255 connects to a garden tiller and uses a spiral auger splitting head to split wood. U.S. Pat. No. 4,945,960 mounts to a larger tractor and is powered by the tractor's top link turn buckle. While these devices are assumably effective for their intended purposes, they are incompatible with skid steer loaders.

While the prior devices concentrate heavily on log splitter attachments for backhoes and tractors, they fail to take advantage of the inherent mobility and rough-terrain capabilities of the skid steer loader. The few log splitter attachments that are intended for skid steer loaders, however, also have disadvantages. U.S. Pat. No. 6,609,547, for example, is horizontally oriented and provides little advantage over conventional wood splitters. Its horizontal orientation requires a large space for storage and makes the skid steer loader less mobile in wooded areas where the wood splitting is likely to occur.

Therefore, it is desirable to have a hydraulically powered log splitter attachment for a skid steer loader that is mobile, effective, easy to use, and fully compatible with and easy to attach to the skid steer loader.

SUMMARY OF THE INVENTION

A hydraulically powered log splitter attachment for a skid steer loader according to the present invention includes a mounting framework attached to an elongate beam having a generally vertical configuration. A piston/cylinder combination is mounted to the elongate beam and has a rod for relative back and forth movement between a retracted configuration and a downwardly extended configuration. A wedge is attached to a lower end of the rod for splitting a log when the log is positioned beneath the piston/cylinder combination and the rod is at the extended configuration. A base plate is attached to the elongate beam adjacent the lower end, and storage wall assemblies and stabilizing plates may be optionally attached to the base plate. The piston/cylinder combination is attached to the hydraulic system of the skid steer loader by hydraulic hoses, making the piston/cylinder combination operable by the existing hand controls of the skid steer loader. Wedge guides slidably attach the wedge to the elongate beam, keeping the piston/cylinder combination and the wedge in alignment. The wedge guides may optionally include wedge guide rollers, and the wedge may optionally include wedge rollers.

In use, the skid steer loader is driven up to the log splitter attachment and secured to the mounting framework. A piece of wood is placed on the base plate while the rod is in the retracted configuration. The user manipulates the skid steer loader's controls in a conventional manner to cause the skid steer loader's hydraulic system to move the rod to the downwardly extended configuration, thus splitting the wood with the wedge. The user again manipulates the skid steer loader's controls to return the rod to the retracted configuration. If the storage wall assemblies are included, the split wood may be stored on the log splitter attachment.

Therefore, a general object of this invention is to provide a hydraulically powered log splitter attachment for a skid steer loader that is mobile.

Another object of this invention is to provide a hydraulically powered log splitter attachment for a skid steer loader, as aforesaid, that is effective in splitting logs.

Still another object of this invention is to provide a hydraulically powered log splitter attachment for a skid steer loader, as aforesaid, that is easy and convenient to use.

Yet another object of this invention is to provide a hydraulically powered log splitter attachment for a skid steer loader, as aforesaid, that is fully compatible with existing skid steer loaders.

A further object of this invention is to provide a hydraulically powered log splitter attachment for a skid steer loader, as aforesaid, that is easy to attach to skid steer loaders.

A still further object of this invention is to provide a hydraulically powered log splitter attachment for a skid steer loader, as aforesaid, which maintains a log in a vertical orientation while being split by a vertically positioned piston/cylinder with wedge.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1A:
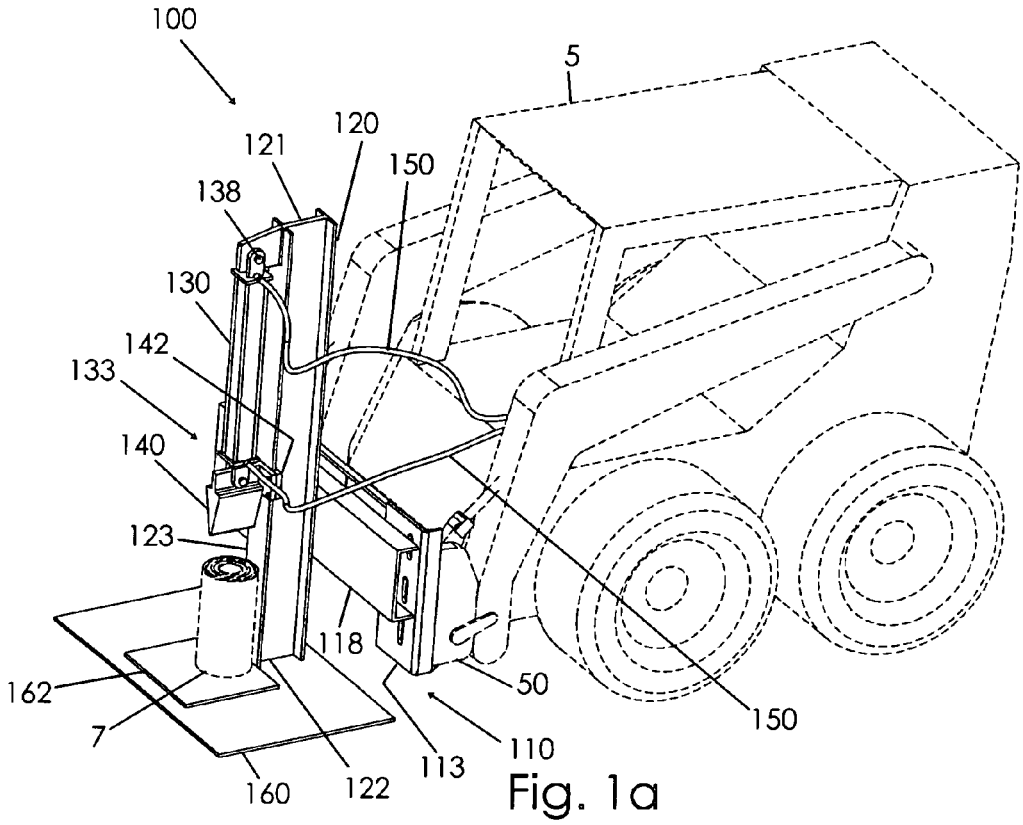
FIG. 1*a* is a perspective view of a log splitting apparatus according to one embodiment of the present invention mounted on a skid steer loader, shown with phantom lines, with a piston/cylinder in a retracted configuration.
Figure 1B:
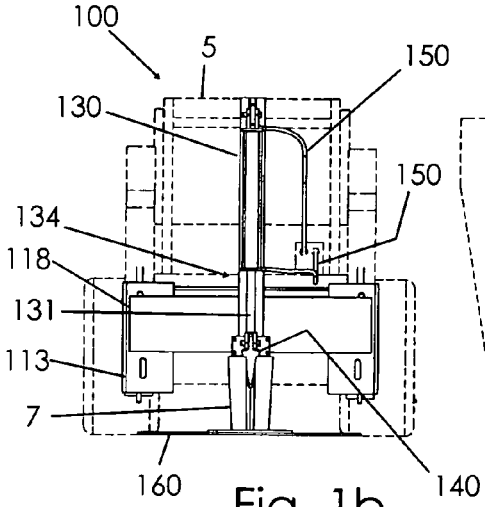
FIG. 1*b* is a front view of the log splitting apparatus as in FIG. 1 mounted on a skid steer loader.
Figure 1C:
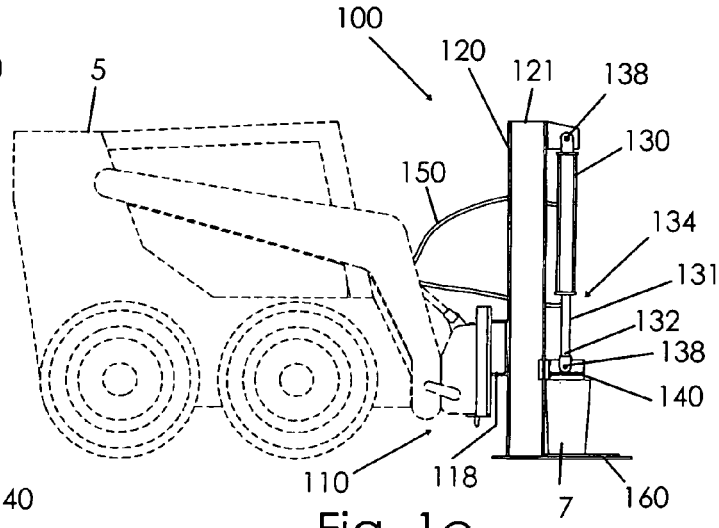
FIG. 1*c* is a side view of the log splitting apparatus as in FIG. 1 mounted on a skid steer loader and with the piston/cylinder in an extended configuration.

A hydraulically powered log splitter attachment for a skid steer loader according to one embodiment of the present invention will now be described in detail with reference to FIGS. 1*a* through 3 of the accompanying drawings. More particularly, a log splitter attachment 100 for a skid steer loader (also referred to herein as a mechanized loader vehicle) 5 according to one embodiment includes a mounting framework 110 attached to an elongate beam 120 having a generally vertical configuration and opposed upper and lower ends 121, 122. A piston/cylinder combination 130 is mounted to a front side 123 adjacent the upper end 121 of the elongate beam 120 and has a rod 131 for relative back and forth movement between a retracted configuration 133 (FIG. 1*a*) and a downwardly extended configuration 134 (FIGS. 1*b* and 1*c*). A wedge 140 is attached to a lower end 132 of the rod 131 for splitting a log 7 when the log 7 is positioned beneath the piston/cylinder combination 130 and the rod 131 is at the extended configuration 134. A base plate 160 is attached to the elongate beam 120 at the lower end 122.

Figure 3:
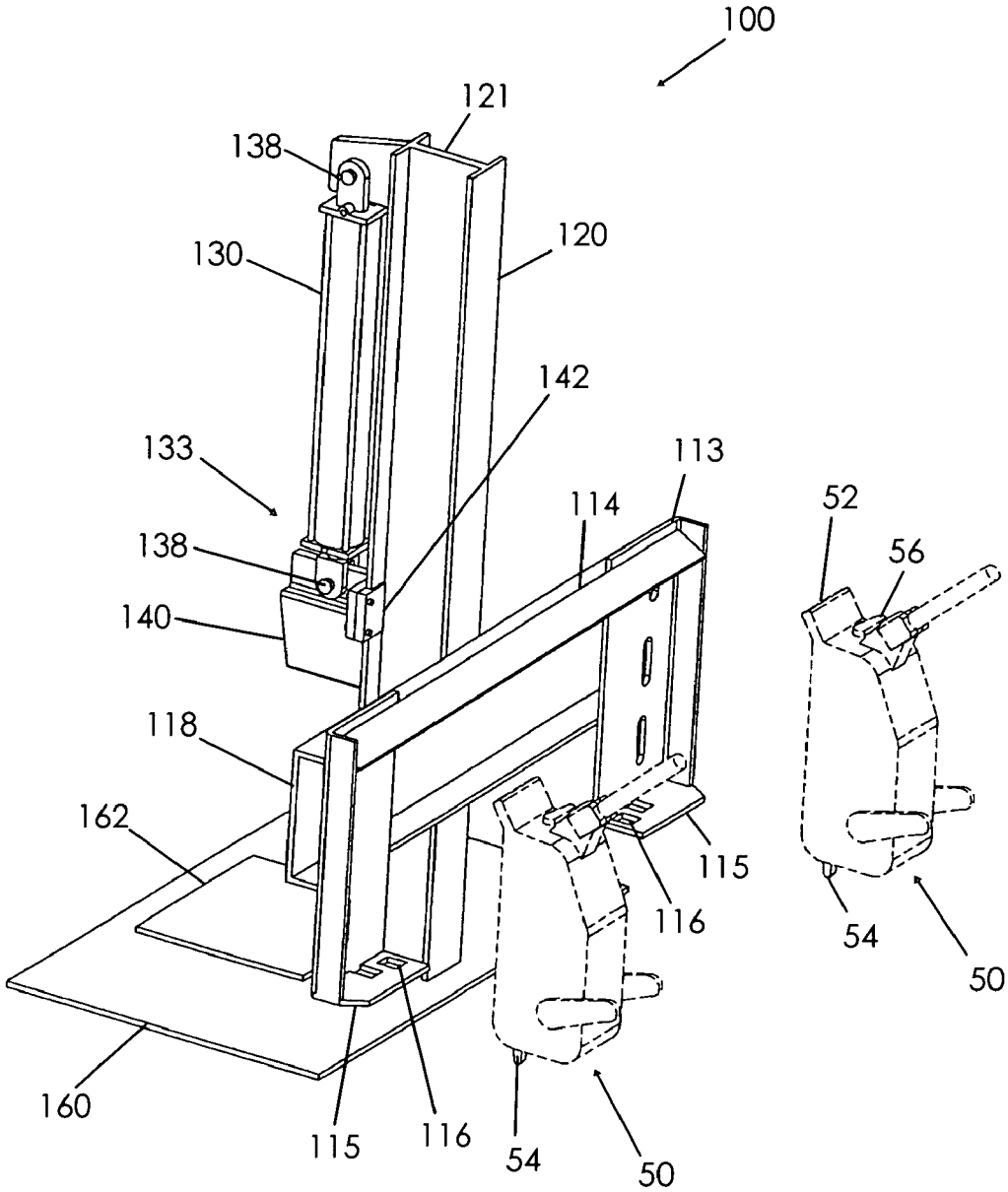
FIG. 3 is a perspective view of the log splitting apparatus as in FIG. 1 with two attachment feet from the skid steer loader shown in phantom lines.
Figure 4A:
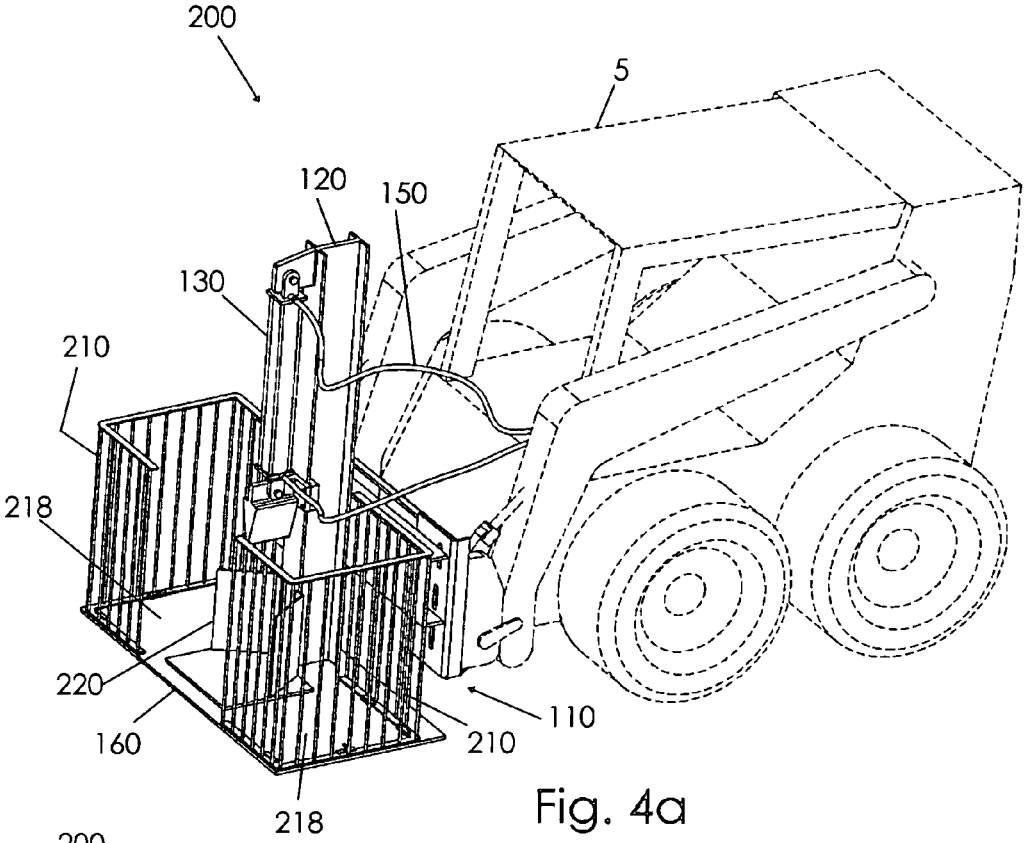
FIG. 4*a* is a perspective view of a log splitting apparatus according to another embodiment of the present invention mounted on a skid steer loader.
Figure 4B:
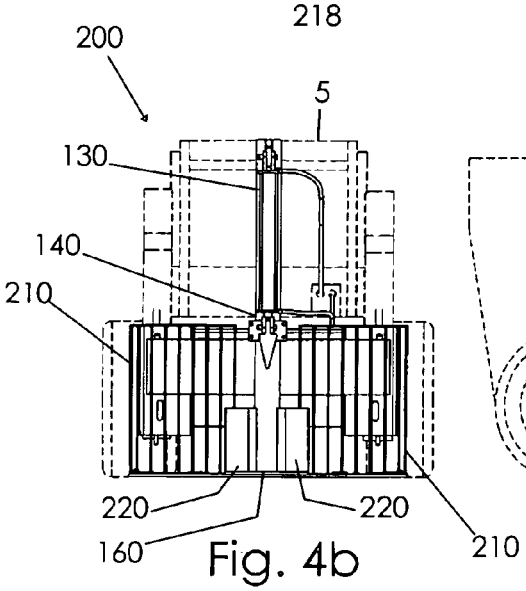
FIG. 4*b* is a front view of the log splitting apparatus as in FIG. 4*a* mounted on a skid steer loader.
Figure 4C:
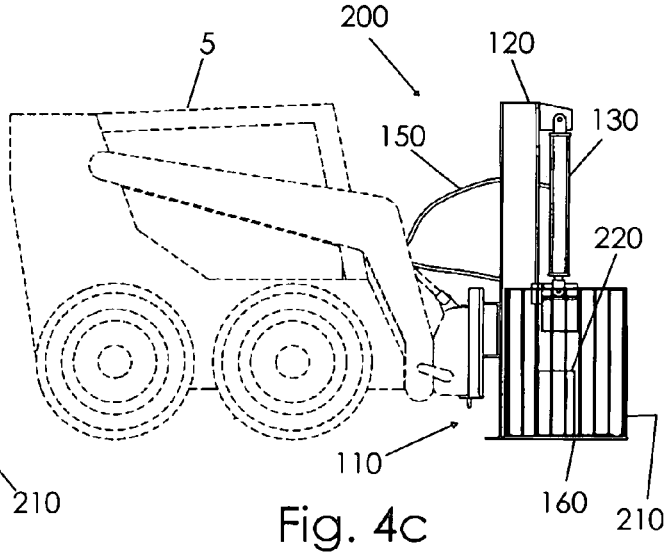
FIG. 4*c* is a side view of the log splitting apparatus as in FIG. 4*a* mounted on a skid steer loader.
Figure 5A:
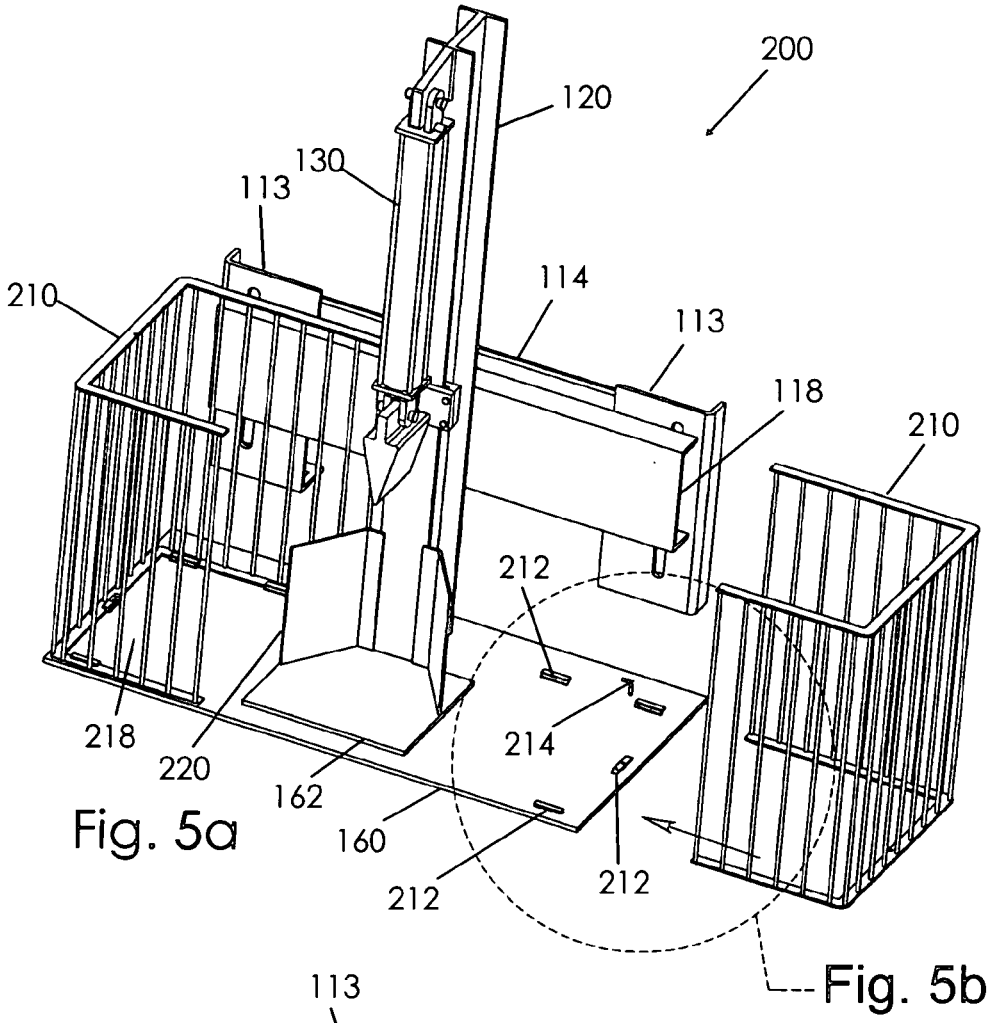
FIG. 5*a* is a partially exploded view of the log splitting apparatus as in FIG. 4*a;*
Figure 5B:
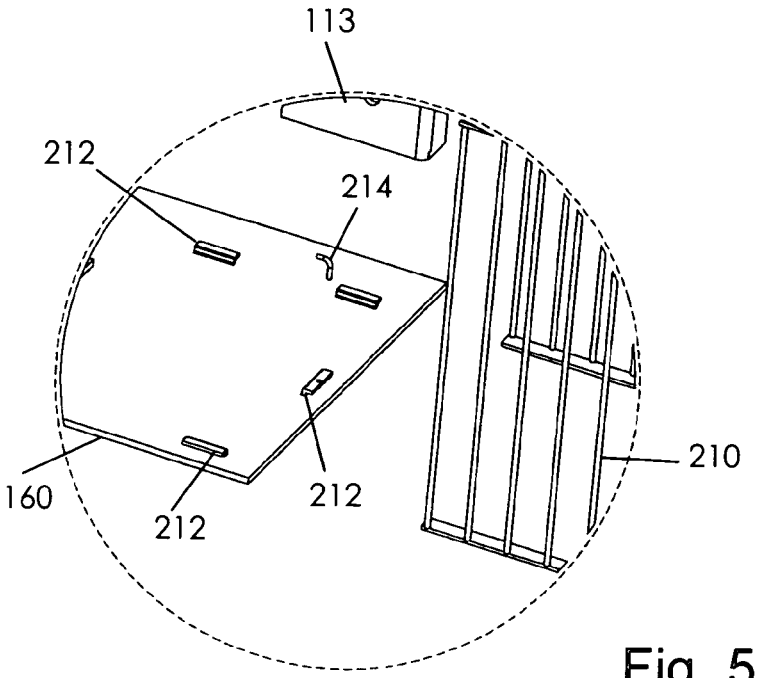
FIG. 5*b* is an isolated sectional view on an enlarged scale of a storage wall and its connecting means as in FIG. 5*a;*

The mounting framework 110 has a mounting member 112 for removable attachment to the skid steer loader 5 and is best shown in FIG. 3. The mounting member 112 includes an attachment frame 113 that has a generally vertical configuration, an angled attachment bracket 114 attached to the attachment frame 113, and a horizontal attachment bracket 115 attached to the attachment frame 113 below an angled attachment bracket 114. The angled attachment bracket 114 extends angularly from the attachment frame 113 for being selectively engaged by a top lip 52 of a skid steer loader's attachment foot 50. The horizontal attachment bracket 115 extends generally perpendicular to the elongate beam 120 and includes at least one attachment hole 116 for selectively receiving a bottom locking mechanism 54 of each attachment foot 50. The attachment frame 113 and the horizontal attachment bracket 115 may each be divided into multiple pieces to conserve materials and reduce the weight of the log splitter attachment 100, as seen throughout the drawings. Nevertheless, these pieces will still be collectively referred to as if intact and integrally constructed.

The mounting framework 110 also has a support member 118 mounted to the attachment frame 113 and the elongate beam 120. The support member 118 primarily provides structural reinforcement for the mounting member 112 and may be eliminated if the attachment frame 113 is undivided and sufficiently strong. If the support member 118 is not used, the attachment frame 113 will mount directly to the elongate beam 120.

The elongate beam 120 is positioned generally vertically for several key reasons. The vertical orientation reduces the footprint of the log splitter attachment 100 to allow storage in any place that the loader 5 or other attachments are stored and to maintain the mobility of the loader 5 in wooded areas where the wood splitting is likely to occur. It also allows the user to place the log in the cutting position easily with little or no lifting. Perhaps most importantly, the vertical orientation is safer for the machinery and the user. Regarding the machinery, the vertical orientation allows the ground to be used as a support for the log splitter attachment 100, eliminating the damage or deformation problems that may occur in horizontal designs that have no external support for the cutting base. The vertical orientation reduces the potential for operator injury since wood that splits violently or attempts to kick out of the splitter will not be propelled up into the air to the extent common with horizontal splitters.

Figure 2:
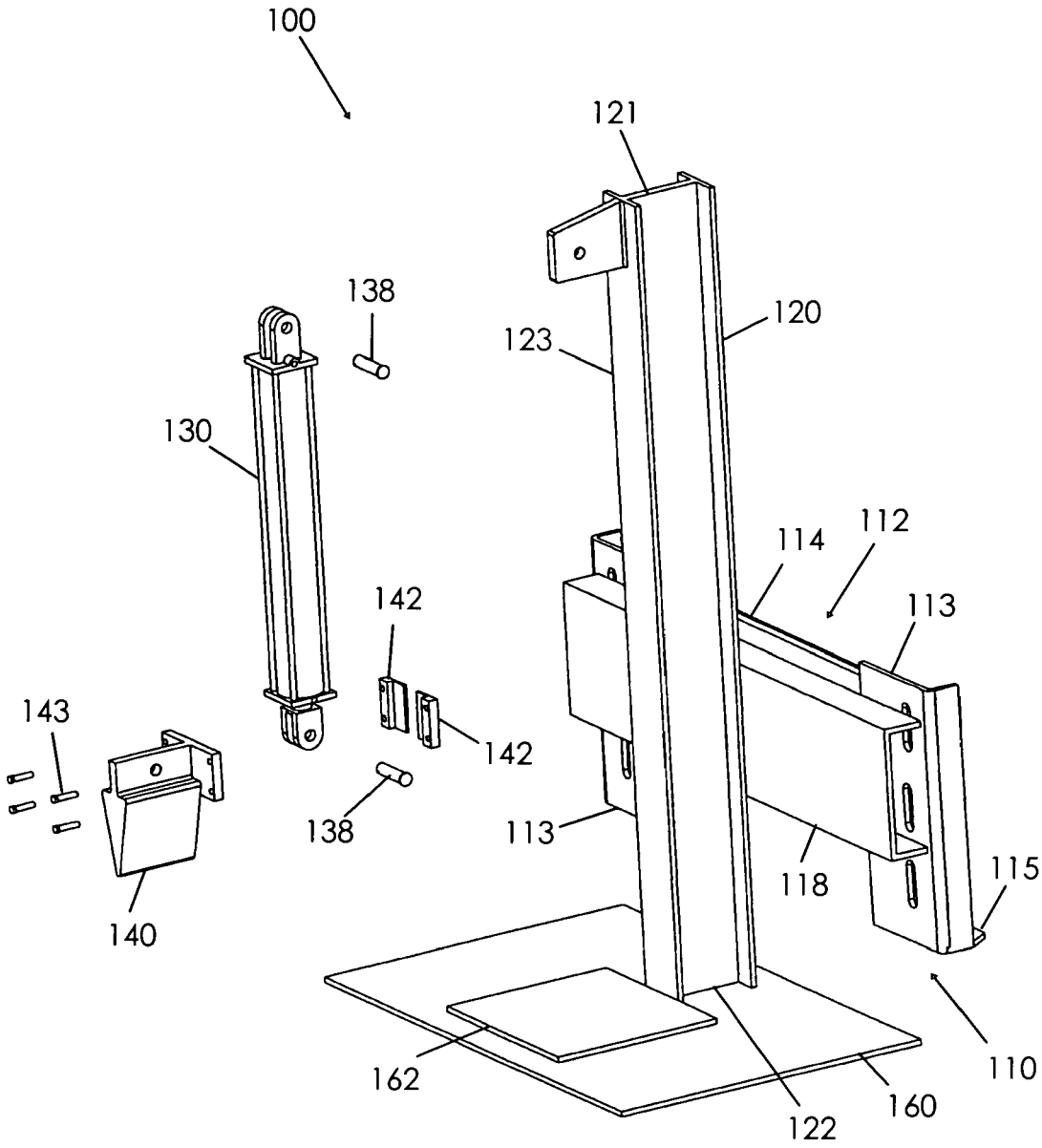
FIG. 2 is an exploded view of the log splitting apparatus as in FIG. 1.

The piston/cylinder combination 130 is preferably mounted to the elongate beam 120 in a way that allows the user to easily remove parts or perform maintenance on the components, and the wedge 140 is preferably mounted to a lower end 132 of the rod 131 in a like manner. Pins 138 are preferably used to connect the piston/cylinder combination 130 to the elongate beam 120 and to connect the wedge 140 to the rod lower end 132; these connections are able to both withstand the vertical stresses when the log splitter attachment 100 is in use and allow some minimal movement to compensate for uneven pressure along the wedge. This is best seen in FIG. 2. Other suitable attachment methods are of course possible, however.

The piston/cylinder combination 130 may be connected to the hydraulic system of the skid steer loader 5 by hydraulic hoses 150, making the piston/cylinder combination 130 operable by the existing hand controls (not shown) of the skid steer loader 5. The hydraulic hoses 150 are best shown in FIGS. 1*a* through 1*c*.

Figure 6A:
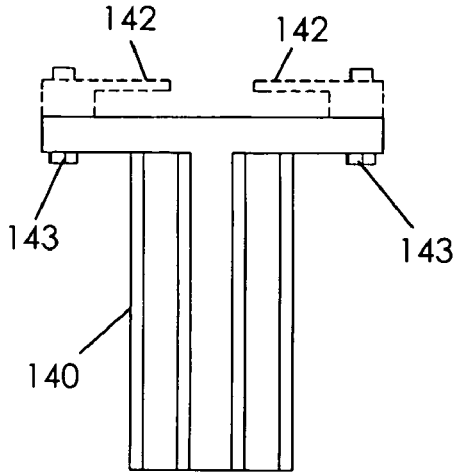
FIG. 6*a* is a top view of a wedge according to the present invention.
Figure 6B:
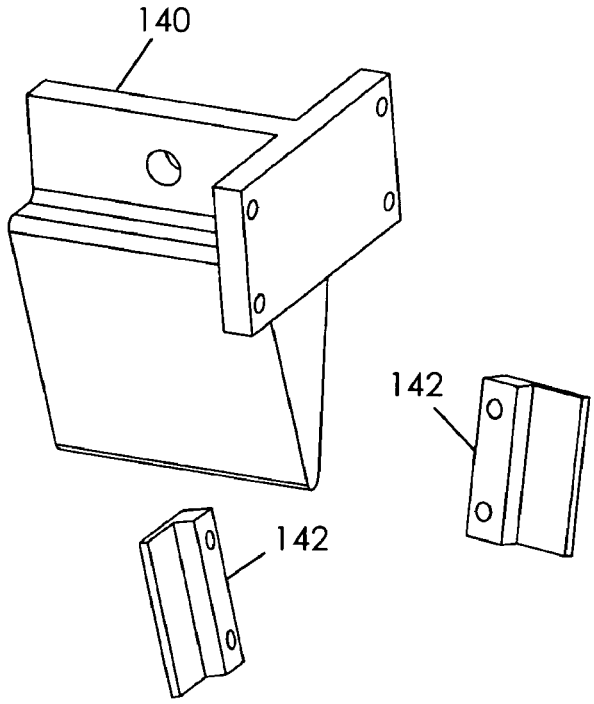
FIG. 6*b* is an exploded view of a basic wedge and wedge guides according to the present invention.

The wedge 140 is slidably attached to the elongate beam 120 by wedge guides 142 to keep the piston/cylinder combination 130 and the wedge 140 in alignment. The wedge 140 is connected to the wedge guides 142 by bolts 143. The wedge 140 and the wedge guides 142 are shown more particularly in FIGS. 6*a* and 6*b,* and the attachment to the elongate beam 120 is best shown in FIGS. 1*a* through 1*c* and FIG. 3. While the elongate beam 120 is preferably an I-beam (as shown throughout the drawings,) other beams could be used.

The base plate 160 provides a flat, sturdy surface to support a log 7 while being split and optionally includes cutting plate 162, which may have special characteristics for holding the log 7 or simply provide extra structural support to the base plate 160.

In use, the skid steer loader 5 may be driven up to the log splitter attachment 100 and the attachment foot 50 may be tilted to hook the attachment foot top lip 52 under the angled attachment bracket 114. An attachment foot lever 56 activates the attachment foot bottom locking mechanism 54, which then goes into the attachment holes 116 and secures the log splitter attachment 100 to the skid steer loader 5. The hydraulic hoses 150 may then be connected to the hydraulic system of the skid steer loader 5 whereby to connect the hydraulic system to the piston/cylinder combination 130.

Next, a piece of wood 7 may be placed on the base plate 160 while the rod 131 is in the retracted configuration 133 (FIG. 1*a*). The controls of the skid steer loader 5 may then be manipulated in a conventional manner to cause the hydraulic system of the skid steer loader 5 to move the rod 131 to the downwardly extended configuration 134, thus splitting the wood 7 with the wedge 140 (FIGS. 1*b* and 1*c*). The controls of the skid steer loader 5 may finally be manipulated to cause the hydraulic system of the skid steer loader 5 to move the rod 131 back to the retracted configuration 133, at which time another piece of wood 7 may be placed on the base plate 160.

The skid steer loader 5 can still travel normally while attached to the log splitter attachment 100, and it may also tilt the log splitter attachment 100 and move it up and down. It may prove helpful to slightly tilt the log splitter attachment 100, as this may help stabilize the wood 7 being split.

A log splitter attachment 200 for a skid steer loader 5 according to another embodiment of the present invention is shown in FIGS. 4*a* through 5*b* and includes a construction substantially similar to the construction previously described except as specifically noted below. More particularly, the log splitter attachment 200 according to this embodiment includes two storage wall assemblies 210 and stabilizing plates 220.

The storage wall assemblies 210 connect to the base plate 160 to form storage areas 218 for split logs on each side of the base plate 160. Bracket guides 212 are fixedly attached to the base plate 160, and the storage wall assemblies 210 are removably attached to the bracket guides 212. A pin 214 is used to further secure each storage wall assembly 210 to the base plate 160, although other suitable fastening means may be used.

The stabilizing plates 220 attach to the base plate 160 and extend upwardly therefrom. The stabilizing plates 220 have two basic functions. First, they help secure the log 7 while it is being split. They also provide a barrier between where the log 7 is placed to be split and the storage areas 218. This prevents the split logs in the storage areas 218 from interfering with the log 7 that is being split.

Figure 6C:
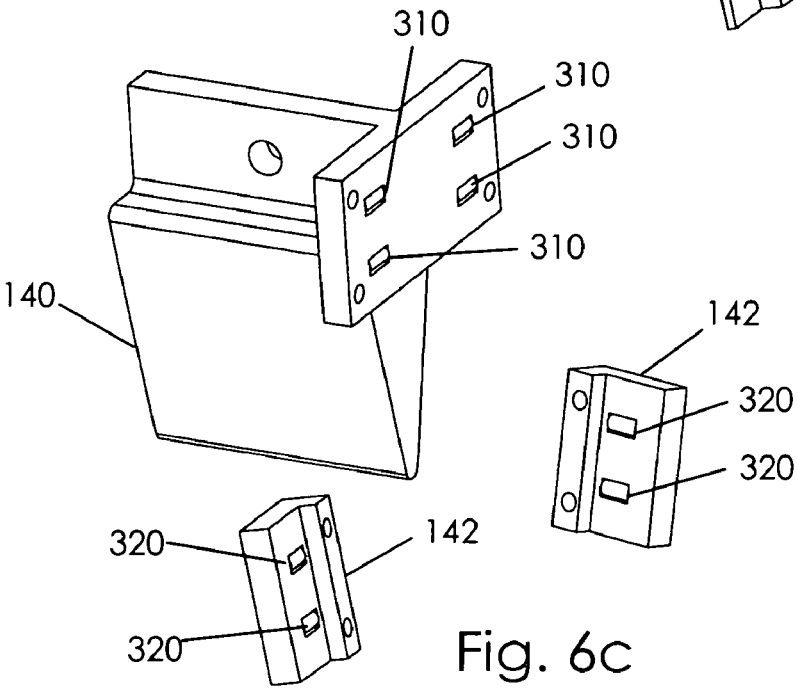
FIG. 6*c* is an exploded view of an alternate wedge and alternate wedge guides.

A log splitter attachment (not shown) for a skid steer loader 5 according to still another embodiment of the present invention includes a construction substantially similar to the construction previously described except as specifically noted below. More particularly, according to this embodiment the wedge 140 includes wedge rollers 310, and the wedge guides 142 include wedge guide rollers 320 (FIG. 6*c*).

The wedge rollers 310 and the wedge guide rollers 320 allow the wedge 140 to smoothly travel along the elongate beam 120. Without the wedge rollers 310 and the wedge guide rollers 320, operation is not as smooth and can eventually lead to excessive wear on the elongate beam 120, the wedge guides 142, and the wedge 140. These parts may also corrode and rust together if unused for a long period of time and the wedge rollers 310 and the wedge guide rollers 320 are not present. The wedge rollers 310 and the wedge guide rollers 320 may be incorporated into any of the above embodiments of the present invention, either individually or jointly.

It is understood that while certain forms of this invention have been illustrated and described, it is not limited thereto except insofar as such limitations are included in the following claims and allowable functional equivalents thereof.

The invention claimed is:

1. A log splitting apparatus for use with a mechanized loader vehicle, said log splitting apparatus comprising:

a mounting framework having a mounting member for removable attachment to the loader vehicle;

an elongate beam mounted to said mounting framework having a generally vertical configuration, said beam having opposed upper and lower ends;

a piston/cylinder combination mounted to a front side of said elongate beam and adjacent said upper end, said piston/cylinder combination having a rod for relative back and forth movement between a retracted configuration and a downwardly extended configuration;

a wedge mounted to a lower end of said rod for splitting a log when a log is positioned beneath said piston/cylinder combination and said rod is at said extended configuration;

a wedge guide fixedly attached to said wedge and operatively connected to said elongate beam for slidable movement therealong, said wedge guide including at least one roller for smoothly guiding said wedge vertically along said elongate beam.

2. The log splitting apparatus as in claim 1 wherein said mounting member includes:

an attachment frame positioned generally parallel to said elongate beam;

an angled attachment bracket extending rearwardly from said attachment frame for selectively engaging a top lip of an attachment foot of the loader vehicle; and a horizontal attachment bracket attached to said attachment frame below said angled attachment bracket, said horizontal attachment bracket extending generally perpendicular to said elongate beam and defining at least one attachment hole for selectively receiving a bottom locking mechanism of the attachment foot.

3. The log splitting apparatus as in claim 2 wherein said horizontal attachment bracket further defines a plurality of attachment holes for making said apparatus compatible with multiple types of mechanized loader vehicles.

4. The log splitting apparatus as in claim 1 further comprising a base plate connected to said lower end of said elongate beam, said base plate being positioned generally perpendicular to said elongate beam.

5. The log splitting apparatus as in claim 4 further comprising a pair of stabilizing plates connected to said base plate and extending upwardly therefrom for stabilizing a log as it is being split.

6. The log splitting apparatus as in claim 5 further comprising at least one storage wall assembly attached to said base plate and extending upwardly therefrom, whereby to form a storage area for split logs.

7. The log splitting apparatus as in claim 4 further comprising at least one storage wall assembly and means for removably attaching said at least one storage wall assembly to said base plate, whereby to form a storage area when said at least one storage wall assembly is attached to said base plate.

8. The log splitting apparatus as in claim 4 further comprising:

a plurality of bracket guides attached to said base plate; and at least one storage wall assembly releasably attached to said bracket guides, said at least one storage wall assembly extending upwardly from and generally perpendicular to said base plate when said at least one storage wall assembly is attached to said bracket guides.

9. The log splitting apparatus as in claim 1 further comprising a wedge guide fixedly attached to said wedge and slidably attached to said elongate beam for guiding said wedge vertically along said elongate beam.

10. The log splitting apparatus as in claim 1 wherein said wedge includes at least one roller for smooth vertical movement along said elongate beam.

11. The log splitting apparatus as in claim 1 further comprising means for attaching said piston/cylinder combination to a hydraulic system of the loader vehicle.

12. A log splitting apparatus for use with a mechanized loader vehicle having an attachment foot for accessory attachment, said log splitting apparatus comprising:

a mounting framework having a mounting member for removable attachment to said attachment foot;

an elongate beam mounted to said mounting framework having a generally vertical configuration, said beam having opposed upper and lower ends;

a piston/cylinder combination mounted to a front side of said beam and adjacent said upper end, said piston/cylinder combination having a rod for relative back and forth movement between a retracted configuration and a downwardly extended configuration;

a wedge mounted to a lower end of said rod for splitting a log when a log is positioned beneath said piston/cylinder combination and said rod is at said extended configuration; wherein said mounting member includes an attachment frame positioned generally parallel to said elongate beam;

said mounting member further includes an angled attachment bracket extending rearwardly from said attachment frame for selectively engaging a top lip of said attachment foot; and said mounting member further includes a horizontal attachment bracket attached to said attachment frame below said angled attachment bracket, said horizontal attachment bracket extending generally perpendicular to said elongate beam and defining at least one attachment hole for selectively receiving a bottom locking mechanism of said attachment foot.

13. The log splitting apparatus as in claim 12 wherein said wedge includes at least one roller for smooth vertical movement along said elongate beam.

14. The log splitting apparatus as in claim 13 further comprising a wedge guide fixedly attached to said wedge and operatively connected to said elongate beam for slidable movement therealong, said wedge guide including at least one roller for smoothly guiding said wedge vertically along said elongate beam.

15. The log splitting apparatus as in claim 14 further comprising:

a base plate connected to said lower end of said elongate beam, said base plate being positioned generally perpendicular to said elongate beam;

at least one storage wall assembly; and means for removably attaching said at least one storage wall assembly to said base plate, whereby to form a storage area when said at least one storage wall assembly is attached to said base plate.

16. The log splitting apparatus as in claim 14 further comprising:

a base plate connected to said lower end of said elongate beam, said base plate being positioned generally perpendicular to said elongate beam; and a pair of stabilizing plates connected to said base plate and extending upwardly therefrom for stabilizing a log as it is being split.

17. The log splitting apparatus as in claim 16 further comprising at least one storage wall assembly and means for removably attaching said at least one storage wall assembly to said base plate, whereby to form a storage area when said at least one storage wall assembly is attached to said base plate.

18. The log splitting apparatus as in claim 17 wherein said horizontal attachment bracket further defines a plurality of attachment holes for making said apparatus compatible with multiple types of mechanized loader vehicles.

19. The log splitting apparatus as in claim 12 further comprising means for attaching said piston/cylinder combination to the hydraulic system of the loader vehicle.

* * * * *